US006242992B1

(12) United States Patent
Lakin

(10) Patent No.: US 6,242,992 B1
(45) Date of Patent: Jun. 5, 2001

(54) INTERDIGITAL SLOW-WAVE COPLANAR TRANSMISSION LINE RESONATOR AND COUPLER

(75) Inventor: Kenneth Meade Lakin, Redmond, OR (US)

(73) Assignee: TFR Technologies, Inc., Bend, OR (US)

( * ) Notice: Subject to any disclaimer, the term of this patent is extended or adjusted under 35 U.S.C. 154(b) by 0 days.

(21) Appl. No.: 09/364,607

(22) Filed: Jul. 30, 1999

(51) Int. Cl.[7] ..... H01P 7/00

(52) U.S. Cl. ..... 333/219

(58) Field of Search ..... 333/193, 194, 333/195, 196, 200, 219

(56) References Cited

PUBLICATIONS

Gorur, Karpuz and Alkan, "Characteristic of Periodically Loades CPW Structurs" Aug. 1998, IEEE Microwave and Guided Wave Letters, Vot. 8 No. 8 pp. 278–280.*

* cited by examiner

*Primary Examiner*—Robert Pascal
*Assistant Examiner*—Kimberly E. Glenn
(74) *Attorney, Agent, or Firm*—G. Joseph Buck

(57) ABSTRACT

A interdigital, slow-wave coplanar transmission line resonator utilizing a coupler. Sections of interdigital, slow-wave coplanar transmission lines having lengths of an integral number of quarter waves act as resonators. In one embodiment shorted transmission lines proximately located to the resonators electromagnetically coupled to the resonators to provide input and output ports to the resonators. In another embodiment, transmission lines are connected by taps to the resonators to provide input and output ports.

16 Claims, 9 Drawing Sheets

INTERDIGITAL SLOW-WAVE COPLANAR TRANSMISSION LINE RESONATOR AND COUPLER

1. BACKGROUND OF THE INVENTION a. Field of the Invention

This invention pertains to resonators for use at microwave frequencies. More particularly, this invention pertains to the use of shorted, slow-wave coplanar transmission lines as microwave resonators or filters and devices for coupling to such resonators and filters.

b. Description of the Prior Art

U.S. Pat. No. 5,777,532 ("532") discloses an interdigital, slow-wave coplanar transmission line consisting of two conducting strips that are located upon the surface of a substrate and that have interleaved conducting fingers that extend from the one side of each strip towards the opposite strip. The "532" patent also discloses a second, balanced configuration in which a central conducting strip is bounded on both sides by conducting grounds. Conducting fingers extend from the sides of the central conductor towards the grounds and interleave with conducting fingers extending from the grounds towards the central conductor. The capacitance between the interleaved fingers substantially slows the rate at which an electromagnetic wave propagates along the transmission line in comparison to the rate of propagation in the absence of such interleaved fingers. As a consequence a shorter piece of such transmission line provides a substantially greater time delay as compared with a coplanar transmission line that has no such interleaved fingers.

A section of ordinary coaxial transmission line that is short circuited at one end has been used for impedance matching purposes, and in some instances has been used as a frequency filter, or resonator, at MF, HF, VHF and in some instances at LHF frequencies. The input impedance at the input end of the transmission line opposite to the end that is short-circuited, exhibits a high impedance when the transmission line has a length of one-quarter wave, or an odd integer multiple thereof, and exhibits a low impedance when the transmission line has a length of one-half wave or an integer multiple thereof. At microwave frequencies, waveguides have also been used in a similar manner for the same purposes. However, at microwave frequencies, attempts to use short-circuited coplanar transmission lines as resonators and filters have been severely limited because higher order modes, other than the TEM mode(transverse electric and magnetic field mode) begin to propagate at frequencies that are not far removed from the microwave frequencies at which the shorted section of coplanar transmission line resonates.

2. SUMMARY OF THE INVENTION

Instead of using an ordinary coplanar transmission line, the present invention uses a section of an interdigital slow-wave coplanar transmission line, such as that depicted in FIG. 1, that is short circuited to ground at one end of the transmission line to function as a resonator. The unexpected advantage of using an interdigital, slow-wave coplanar transmission line as a resonator is that, in contrast to using an ordinary co-planar transmission line, the frequencies at which the higher order modes begin to propagate along the interdigital, slow-wave transmission line are displaced much further from the frequencies at which the shorted, slow-wave transmission line is resonant. Because of the greater displacement, the interdigital, slow-wave coplanar transmission line can be used as a resonator for line lengths of odd integral multiples of a quarter-wave without being degraded by the propagation of higher order modes. Because the transmission line resonators that utilize line lengths that are higher odd-integral multiples of a quarter-wave, tend to exhibit a narrower bandwidth or higher Q resonance, such a multiple quarter wavelength resonator that utilizes an interdigital slow-wave coplanar transmission line provides better performance than a resonator that uses a multiple quarter wavelength of ordinary, coplanar transmission line.

An immediate practical problem associated with such a resonator is providing a means at microwave frequencies for connecting to the input port of the resonator. One could simply connect an external transmission line to the open end of the quarter wavelength interdigital, slow-wave coplanar transmission line. However, in such a circumstance the Q of the resonator would be significantly depressed by the loading of the resonator by the impedance of the transmission line. One solution used in an embodiment of this invention is to "tap down" on the resonator by attaching an electrical conducting wire tap from the external transmission line to some point on the central conductor of the interdigital slow-wave coplanar transmission line that was located nearer to the shorted end of the interdigital transmission line. FIG. 4A depicts the use of such a tap.

A second embodiment of invention includes a means for coupling to an interdigital, slow-wave, coplanar transmission line resonator that does not require the addition of wire tap or plated through holes in a substrate. This embodiment, instead, uses a portion of an ordinary coplanar transmission line that is electrically shorted at one end and that is overlaid in close proximity to the resonator, so as to couple the transmission line to the resonator. By using such coupling one avoids any need for wire taps and plated through holes as a means of electrically connecting to the resonator.

3. BRIEF DESCRIPTION OF THE DRAWINGS

Figure 2A:
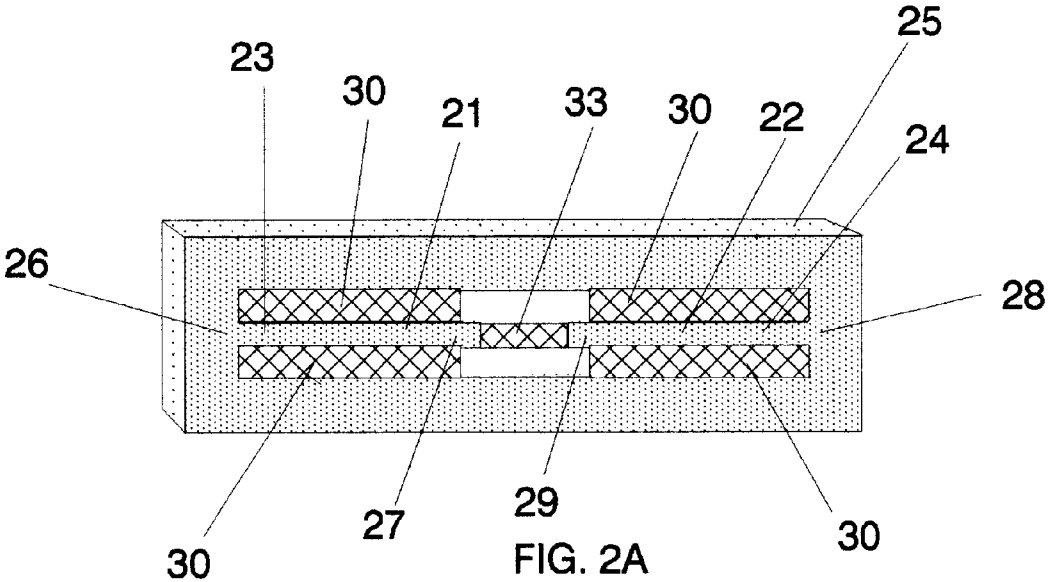
FIG. 2A depicts two resonators coupled together by a capacitance.
Figure 4A:
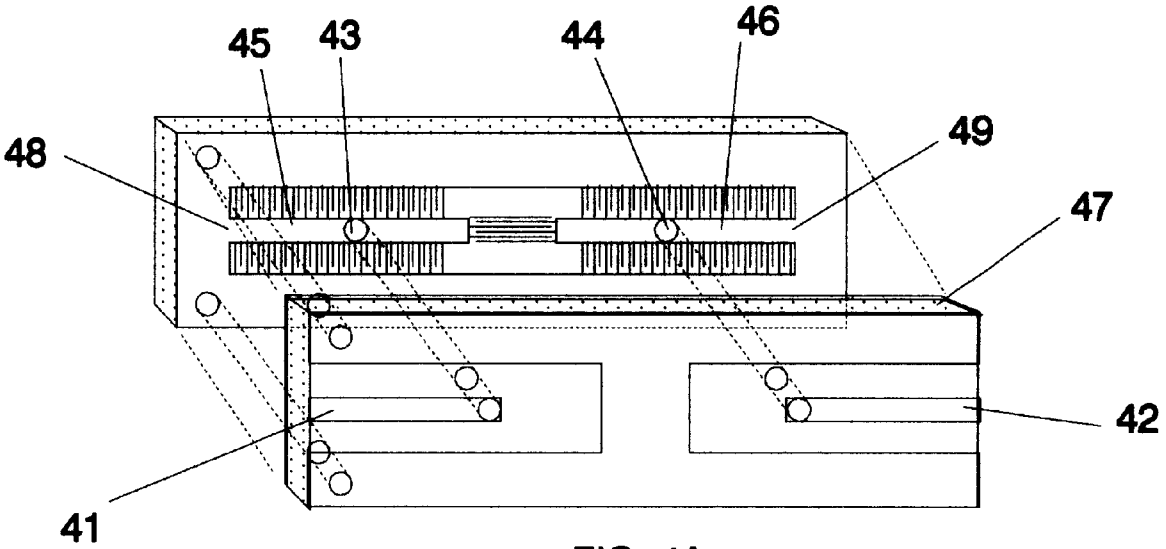

FIG. 4A an embodiment of the invention that uses transmission lines on a substrate that has plated through holes to connect to the resonators depicted in FIG. 2A.

Figure 4B:
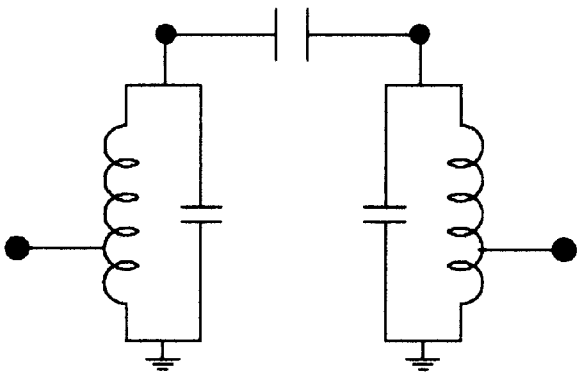

FIG. 4B depicts the equivalent circuit for the device depicted in FIG. 4A.

Figure 5A:
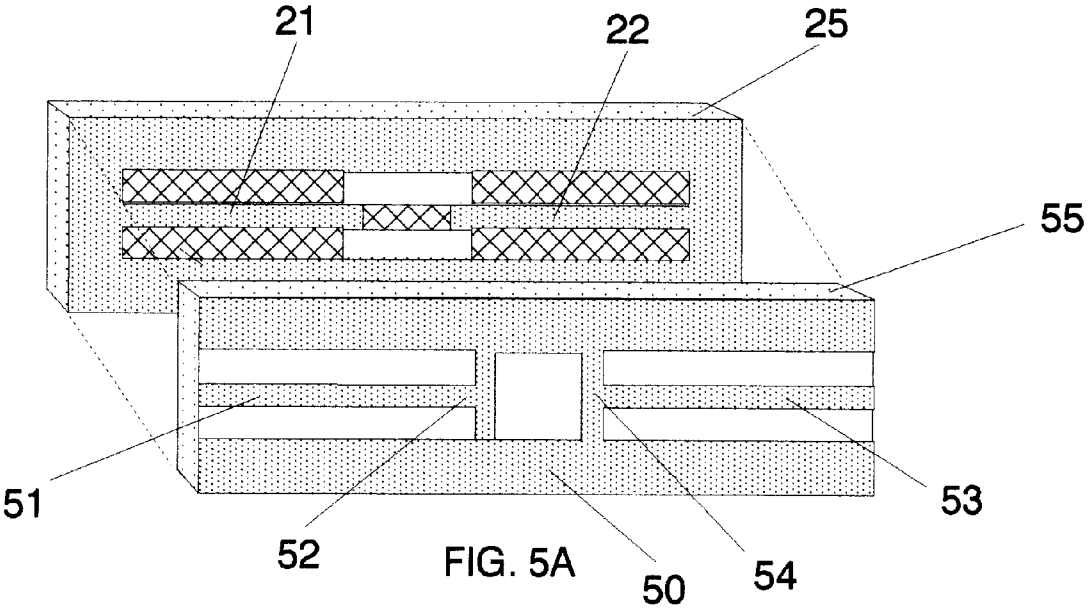

FIG. 5A a second embodiment of the invention in which shorted transmission lines are electromagnetically coupled to a pair of resonators.

Figure 5B:
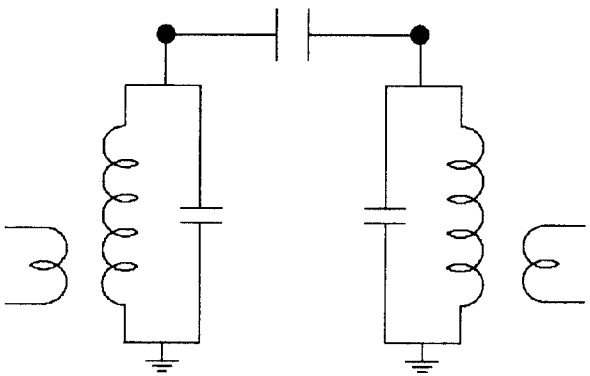

FIG. 5B depicts an equivalent circuit for the device depicted in FIG. 5A.

Figure 6:
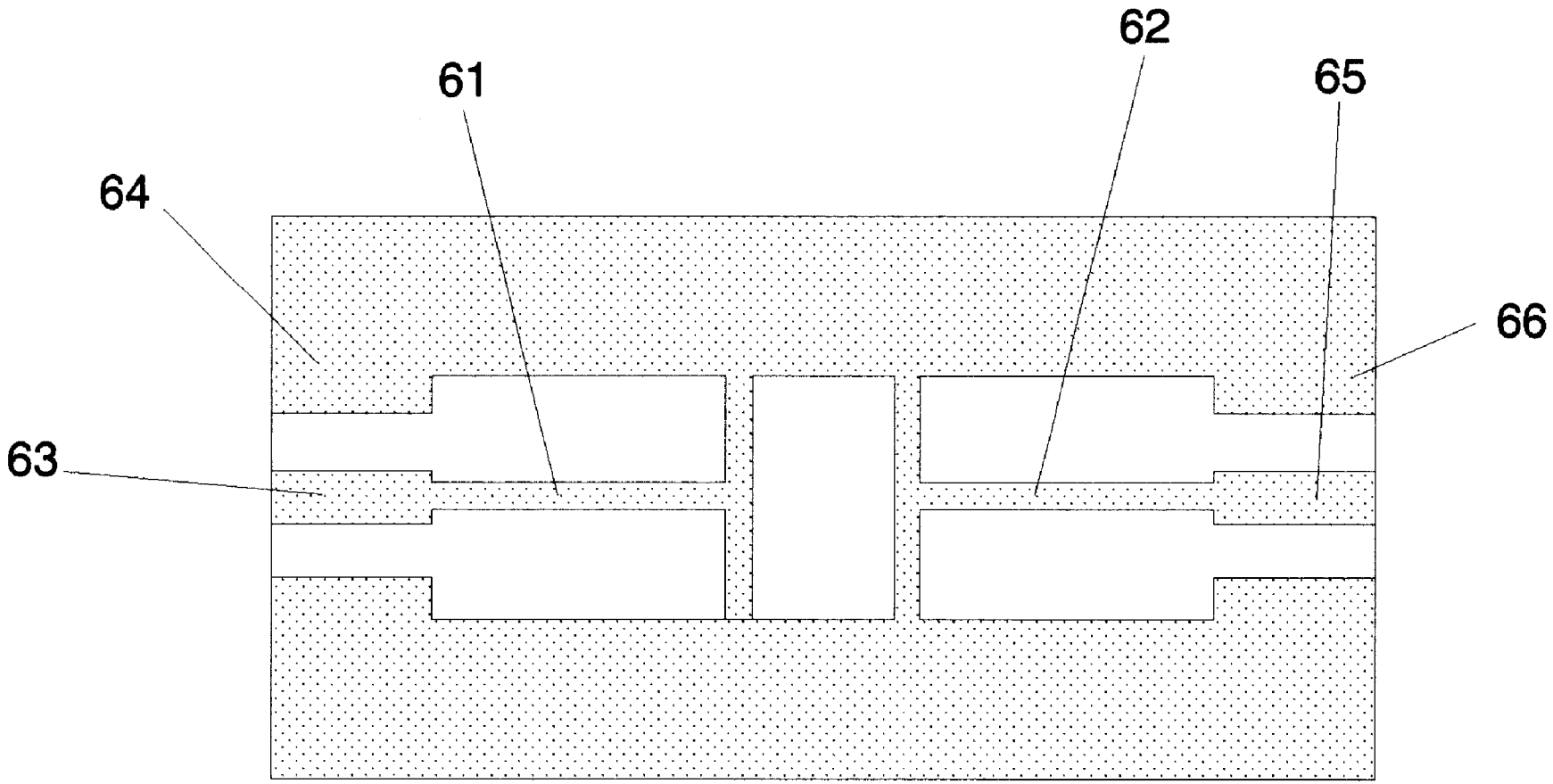
Figure 7:
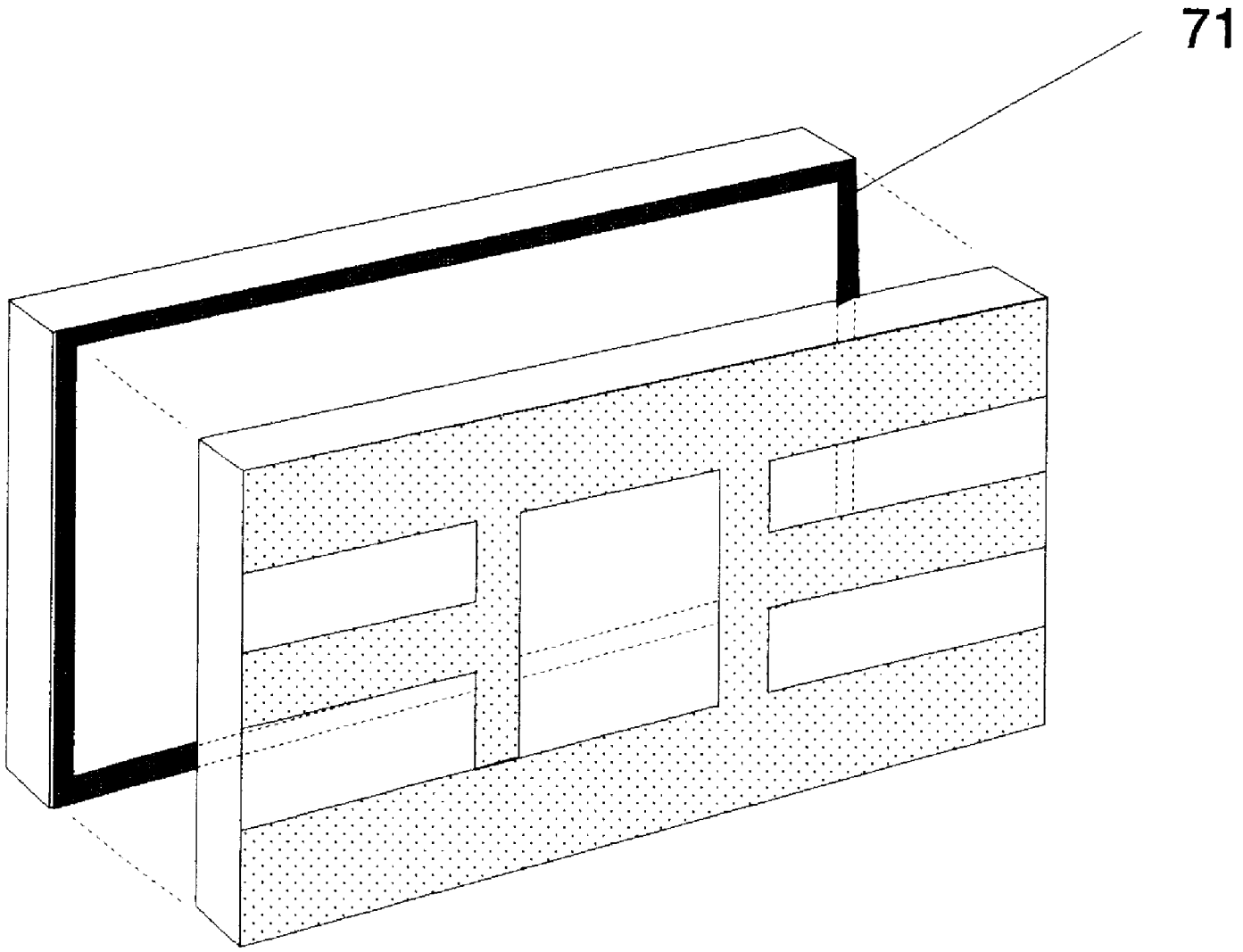

FIG. 6 depicts another embodiment of the shorted transmission lines depicted in FIG. 5A and FIG. 7 depicts the use of a solder seal to mount the substrate carrying the transmission lines upon the substrate upon which the resonators are located.

Figure 8A:
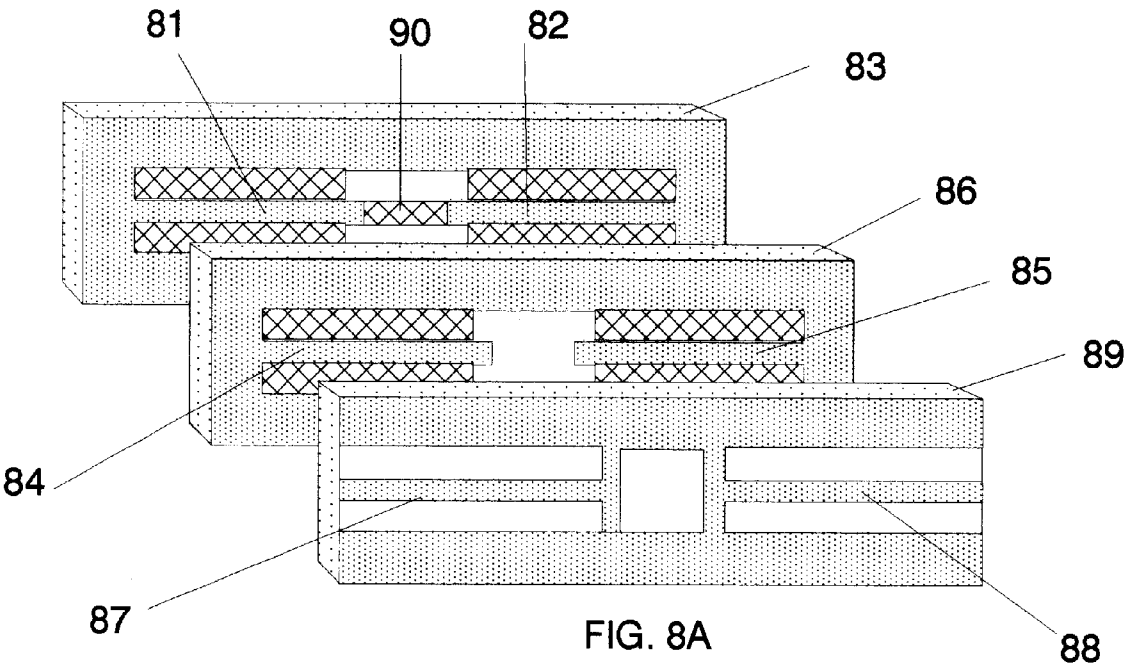
Figure 8B:
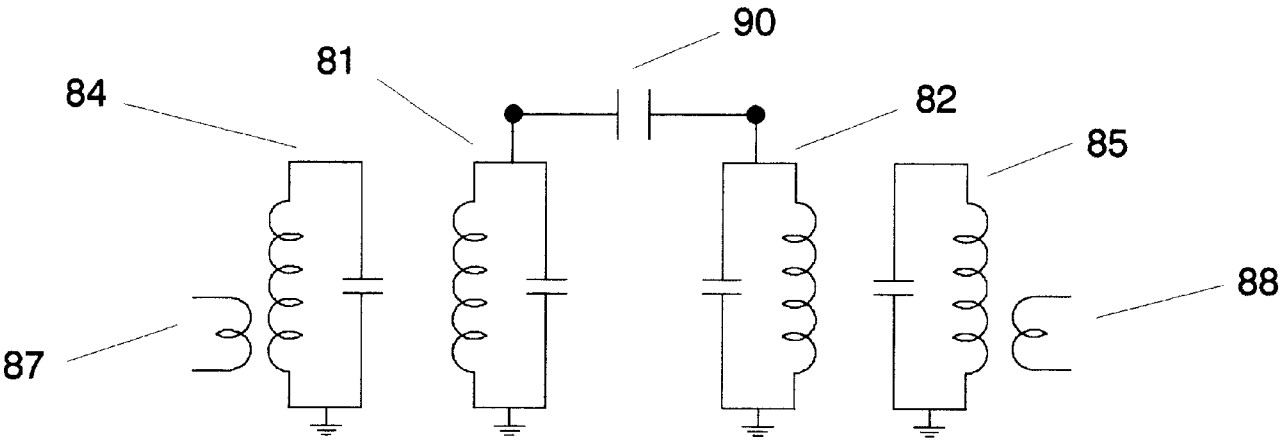

FIG. 8A depicts four resonators and a pair of shorted transmission lines that couple to the resonators and FIG. 8B depicts an equivalent circuit for the device depicted in FIG. 8A.

Figure 9:
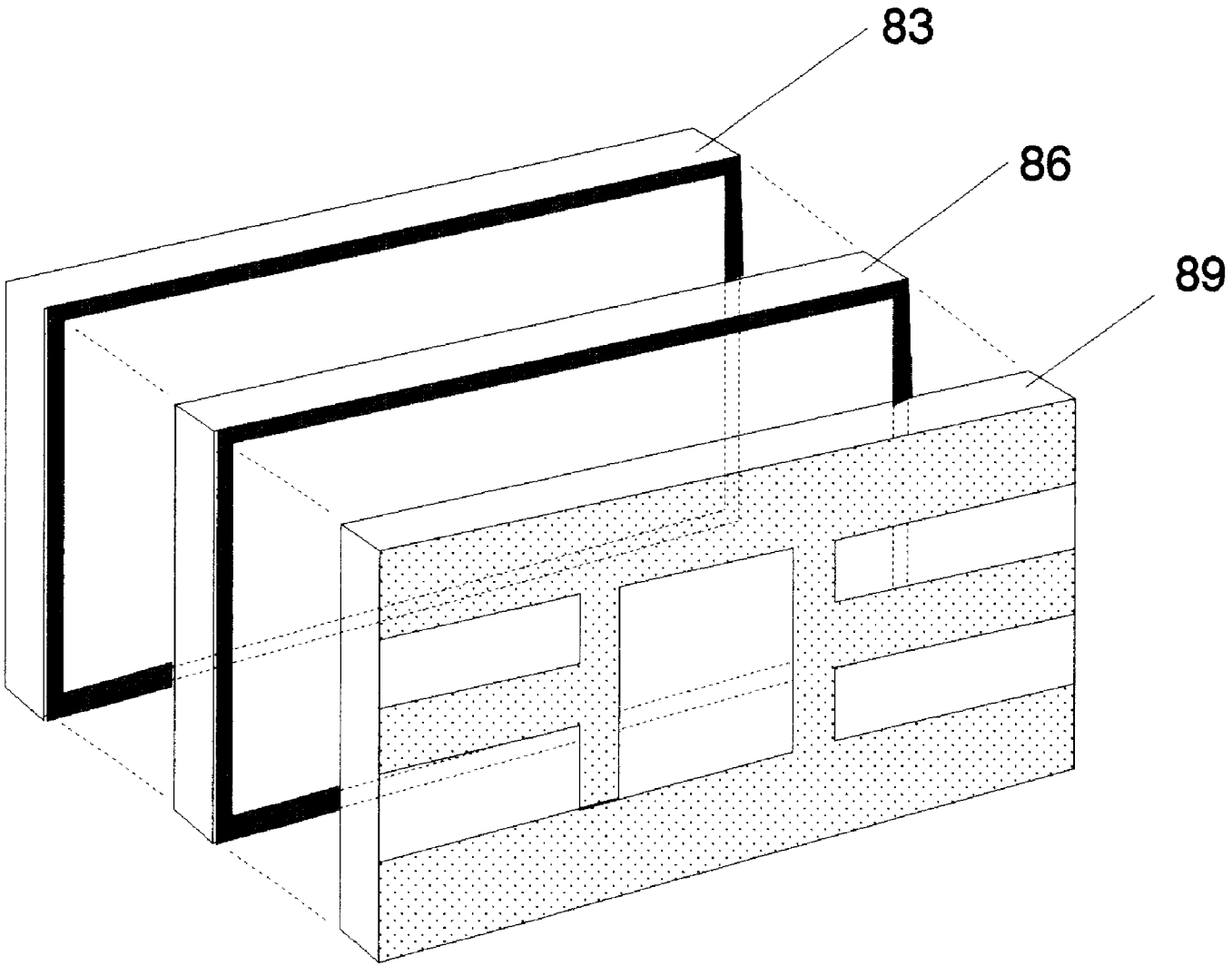

FIG. 9 depicts the fixing together by solder of the three substrates depicted in FIG. 8A.

4. DETAILED DESCRIPTION

Figure 1:
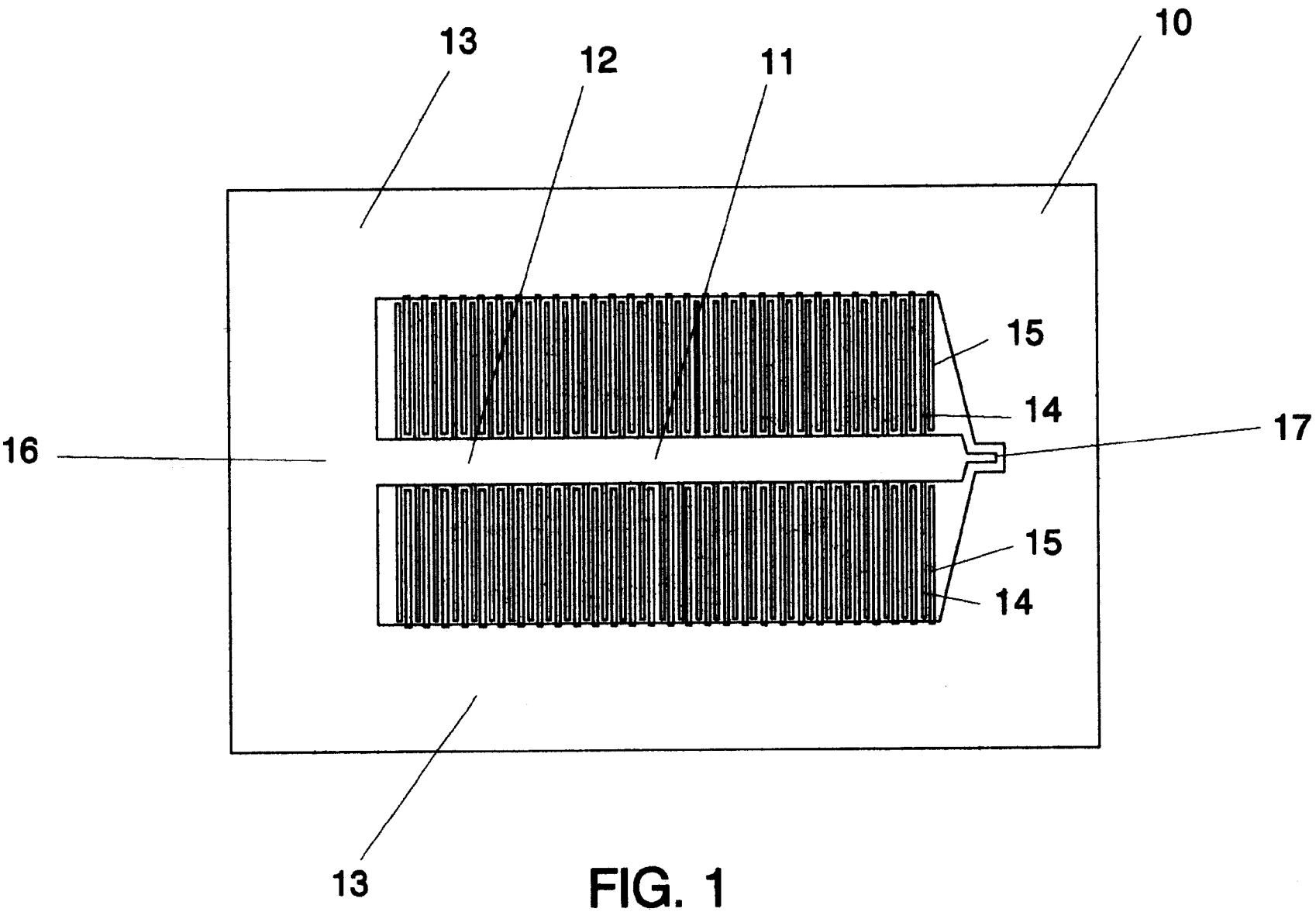
FIG. 1 depicts a resonator formed by a section of interdigital, slow-wave coplanar transmission line.

FIG. 1 depicts an interdigital, slow-wave coplanar transmission line resonator 10 located on the surface of a substrate. Transmission line 11 consists of central conductor 12 and ground conductors 13 that are symmetrically located on both sides of central conductor 12, all of which conductors are fabricated upon the surface of the substrate. Conducting fingers 14 extend from each side of central conductor 12 towards ground conductor 13 and are interleaved with conducting fingers 15 extending from ground conductor 13 towards central conductor 12. As described in the "532" patent, the capacitance between the interleaved fingers substantially slows the propagation of the TEM wave along the transmission line.

Central conductor 12 of transmission line 11 is electrically shorted to ground at shorted end 16. The opposite end of the transmission line serves as the input port 17 to the resonator. Input port 17 exhibits a high impedance at frequencies for which the length of transmission line 11 is a quarter-wave or an odd multiple thereof, and exhibits a low impedance at frequencies for which the length is an even multiple thereof. In analogy to the impedances exhibited by series or parallel combinations of lumped components, the frequencies at which input port 17 exhibits high impedances are referred to as parallel resonances and at which port 17 exhibits low impedances are referred to series resonances.

FIG. 2A depicts an embodiment of the invention that includes resonators 21 and 22 consisting of sections of interdigital slow-wave transmission lines 23 and 24 respectively fabricated upon the surface of substrate 25. Resonator 21 has short-circuited end 26 and input port 27 and resonator 22 has shorted end 28 and input port 29. In FIG. 2, cross-hatched areas 30 denote the interleaved conducting fingers of the interdigital, slow-wave coplanar transmission line. Cross-hatched area 33 denotes a coupling capacitor comprised of interleaved fingers extending between the two resonators that constitute a capacitor that couples the two resonators. FIG. 3 depicts in more detail a portion of the resonators shown in FIG. 2A. FIG. 3 depicts the portions of resonators 21 and 22 that include input ports 27 and 29. As depicted in FIG. 3, conducting fingers 31 extend from port 27 towards port 29 and are interleaved with conducting fingers 32 that extend from port 29 towards port 27. The capacitance between fingers 31 and 32 acts as a lumped capacitance 33 that couples port 27 to port 29 and hence couples resonator 21 to resonator 22.

Figure 2B:
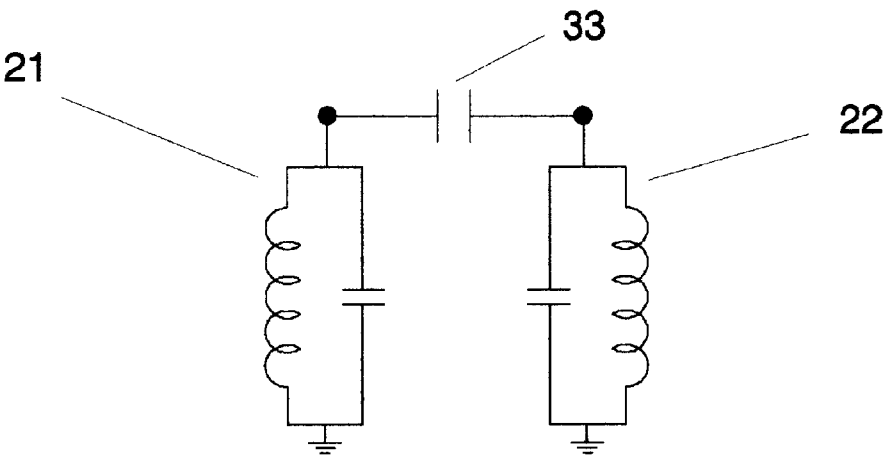
FIG. 2B depicts an equivalent circuit for the two coupled resonators for frequencies in the vicinity of the high-impedance resonance of the resonators.
Figure 3:
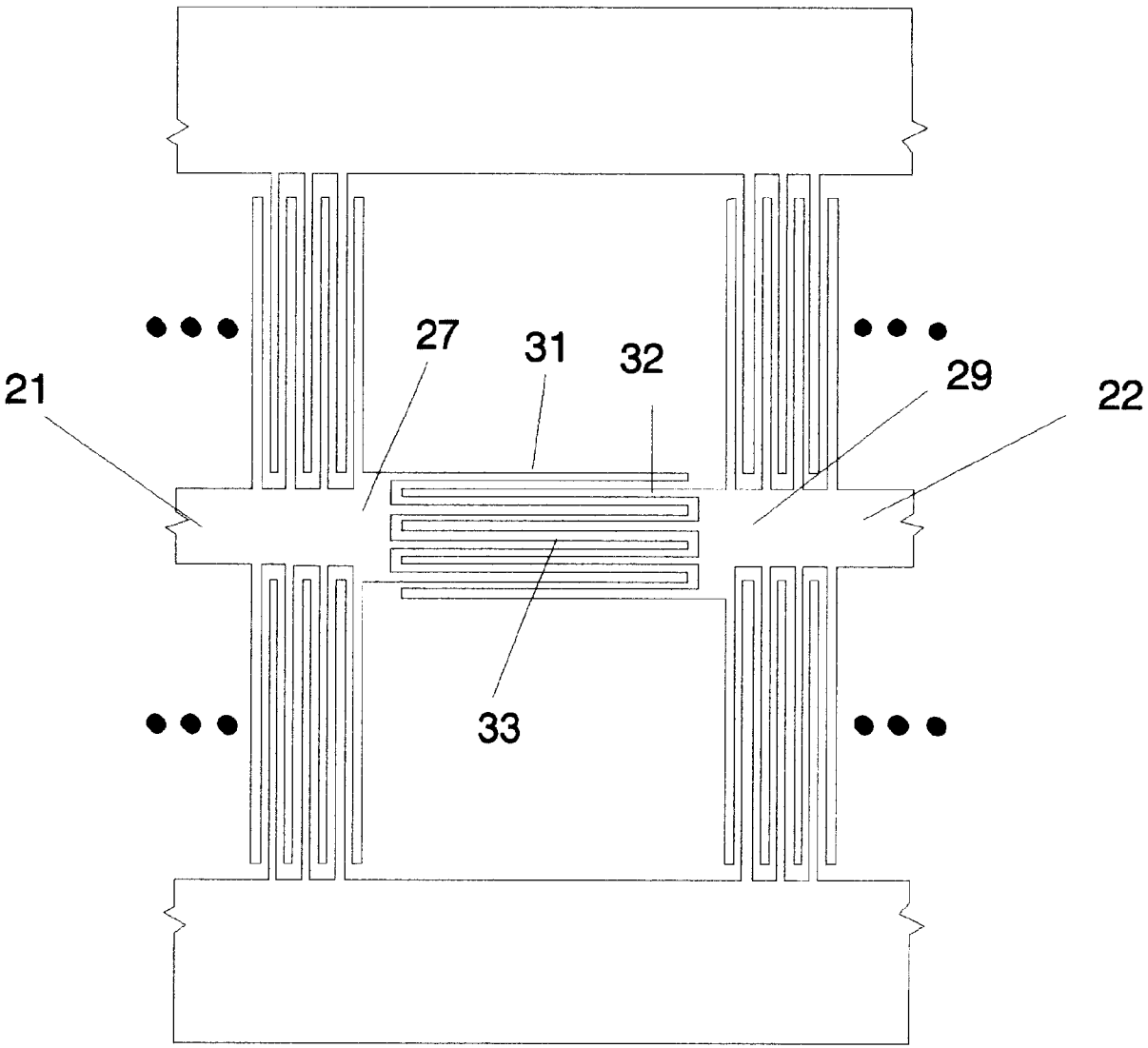
FIG. 3 depicts in more detail the interdigital fingers that act as a capacitance to couple together the two resonators depicted in FIG. 2A.

FIG. 2B depicts the equivalent circuit of resonators 21 and 22 that are coupled together by capacitance 33.

FIG. 4A depicts one method of providing external connections to resonators 21 and 22 of FIG. 2A. External transmission lines 41 and 42 are connected to intermediate points 43 and 44 on the central conductors 45 and 46 by "taps" consisting of plated through holes in the substrate 47 supporting the external transmission lines. Central conductors 45 and 47 are part of resonators 48 and 49 that consist of shorted quarter wavelength sections of interdigital coplanar transmission lines in the same manner as depicted in FIG. 2A. The taps are positioned so as to obtain the desired bandwidths for the resonators. FIG. 4B depicts an equivalent circuit for the device of FIG. 4A in which external connections are "tapped" down on the resonators.

One may also position the taps so as to improve the operation of the filter at harmonics of the frequency of the desired passband. For instance, if the desired passband is centered at the frequency at which the transmission lines that form the resonators are one-quarter of a wave in length, then these resonators will tend also to transmit signals at a harmonic frequency equal to three times the frequency of the pass band, that is, where the transmission lines are ¾'s of a wave in length. However, if the taps are located at points where the nulls occur on the transmission line at this harmonic frequency, then the transmission by the resonators of signals at this harmonic frequency will be inhibited.

FIG. 5A depicts a coupling device 50 for coupling coplanar transmission lines to the resonators, which coupling device avoids the problems associated with using tapped connections and plated through holes. As depicted in FIG. 5A, a portion of coplanar transmission line 51 having a short 52 at its end is used to couple to resonator 21. Similarly a portion of coplanar transmission line 53 having a short 54 at its end is used to couple to resonator 22. Transmission lines 51 and 53 are formed upon the surface of substrate 55 and substrate 55 is then overlaid on top of substrate 25. FIG. 5B depicts an equivalent circuit for the device of 5A. Substrate 55 may be held in position on top of substrate 25 by means of a solder seal 71 as depicted in FIG. 7 or by other suitable means. As an example, an embodiment of the invention for use at 1430 Mhz, used a substrate 55 made of alumina and having a thickness of approximately 6 one-thousandths of an inch.

Although, in FIG. 5A, coupling device 50 is depicted as comprising sections of coplanar transmission lines having uniform widths, in the preferred embodiment depicted in FIG. 6, the dimensions of transmission lines 61 and 62 that overlay the resonators 21 and 22 are sized so as to correspond to the dimensions and locations of the central conductor and ground conductors of resonators 21 and 22 and are then altered in the areas 63, 64, 65 and 66 so as to correspond to the spacings or pitch of standardized connections to printed circuit boards.

FIG. 8A is an exploded view of another embodiment of the invention that includes four coupled resonators. Resonators 81 and 82 on substrate 83 are coupled together by capacitor 90 in a manner similar to that of the resonators depicted in FIG. 2A. Resonators 84 and 85 on substrate 86 are not coupled together by any capacitor. The device of FIG. 8A also includes shorted transmission lines 87 and 88 on substrate 89. As depicted in FIG. 9, substrates 83, 86 and 89 are soldered and stacked together in close proximity so as to couple transmission line 87 to resonator 84 and couple transmission line 88 to resonator 85. The close stacking of these substrates also couples resonator 84 to resonator 81 and resonator 85 to resonator 82. FIG. 8B depicts the equivalent circuit of the four resonators that are coupled in this manner and depicts the transmission lines 87 and 88 as loops inductively coupled to the resonators.

Although the embodiments depict resonators formed from quarter wave-lengths of interdigital coplanar transmission lines that are shorted at one end and open circuited at the other, it should be understood that such resonators could, instead, utilize resonators that are open circuited at both ends, short circuited at both ends, or that are integral multiples of a quarter wavelength in length. It should also be understood that although the resonators are depicted as sections of balanced interdigital coplanar transmission lines having conducting grounds located on both sides of a central conductor, and unbalanced interdigital coplanar transmission line having a ground located on only one side of the conductor could also be used as a resonator.

Although the drawings depict coupled resonators that are coupled to both input and output ports, it should be understood that a single resonator could also be used that is coupled to a single input/output port.

I claim:

1. A microwave resonator device having a resonant frequency and comprising:

a resonator substrate having an upper surface, a section of interdigital slow-wave coplanar transmission line located on the upper surface of the resonator substrate, the section of transmission line acting as a microwave resonator.

2. The device of claim 1 wherein the section of interdigital slow-wave coplanar transmission line is terminated on at least one end by a short circuit.

3. The device of claim 1 wherein the section of interdigital slow-wave coplanar transmission line has a length of approximately an integral number of one-quarter wavelengths at the resonant frequency.

4. The device of claim 1 and further including:

a coupler substrate having top and bottom surfaces, a coplanar transmission line located on the top surface of the coupler substrate and having a short circuit at one end of the coplanar transmission line and having an input port at the other end of the coplanar transmission line, the bottom surface of the coupler substrate being mounted adjacent to the upper surface of the resonator substrate and the microwave resonator being in close proximity to the short circuited end of the coplanar transmission line, whereby the coplanar transmission line is coupled to the microwave resonator.

5. The device of claim 2 and further including:

a coupler substrate having top and bottom surfaces, a coplanar transmission line located on the top surface of the coupler substrate and having a short circuit at one end of the coplanar transmission line and having an input port at the other end of the coplanar transmission line, the bottom surface of the coupler substrate being mounted adjacent to the upper surface of the resonator substrate and the microwave resonator being in close proximity to the short circuited end of the coplanar transmission line, whereby the coplanar transmission line is coupled to the microwave resonator.

6. The device of claim 3 and further including:

a coupler substrate having top and bottom surfaces, a coplanar transmission line located on the top surface of the coupler substrate and having a short circuit at one end of the coplanar transmission line and having an input port at the other end of the coplanar transmission line, the bottom surface of the coupler substrate being mounted adjacent to the upper surface of the resonator substrate and the microwave resonator being in close proximity to the short circuited end of the coplanar transmission line, whereby the coplanar transmission line is coupled to the microwave resonator.

7. The device of claim 1 and further including a transmission line connected by a tap to the microwave resonator.

8. The device of claim 2 and further including a transmission line connected by a tap to the microwave resonator.

9. The device of claim 3 and further including a transmission line connected by a tap to the microwave resonator.

10. A device comprising a plurality of coupled microwave resonators, each having a resonant frequency and comprising:

a resonator substrate having an upper surface and having a plurality of microwave resonators located on the upper surface of the resonator substrate, each microwave resonator comprising a section of interdigital slow-wave coplanar transmission line and having a length approximately equal to an integral number of one-quarter wavelengths at the resonant frequency of the resonator, at least two of the microwave resonators being coupled together by a capacitance.

11. The device of claim 10 wherein each section of interdigital slow-wave coplanar transmission line is terminated on at least one end by a short circuit.

12. The device of claim 10 wherein the plurality of resonators comprise at least a first and second resonator and further including:

a coupler substrate having top and bottom surfaces, a first coplanar transmission line located on the top surface of the coupler substrate and having a short circuit at one end of the first coplanar transmission line and having an input port at the other end of the first coplanar transmission line, a second coplanar transmission line located on the top surface of the coupler substrate and having a short circuit at one end of the second coplanar transmission line and having an output port at the other end of the second coplanar transmission line, the bottom surface of the coupler substrate being mounted adjacent to the upper surface of the resonator substrate and the first microwave resonator being in close proximity to the short circuited end of the first coplanar transmission line, whereby the first coplanar transmission line is coupled to the first microwave resonator and the second microwave resonator being in close proximity to the short circuited end of the second coplanar transmission line, whereby the second coplanar transmission line is coupled to the second microwave resonator.

13. The device of claim 11 wherein the plurality of resonators comprise at least a first and second resonator and further including:

a coupler substrate having top and bottom surfaces, a first coplanar transmission line located on the top surface of the coupler substrate and having a short circuit at one end of the first coplanar transmission line and having an input port at the other end of the first coplanar transmission line, a second coplanar transmission line located on the top surface of the coupler substrate and having a short circuit at one end of the second coplanar transmission line and having an output port at the other end of the second coplanar transmission line, the bottom surface of the coupler substrate being mounted adjacent to the upper surface of the resonator substrate and the first microwave resonator being in close proximity to the short circuited end of the first coplanar transmission line, whereby the first coplanar transmission line is coupled to the first microwave resonator and the second microwave resonator being in close proximity to the short circuited end of the second coplanar transmission line, whereby the second coplanar transmission line is coupled to the second microwave resonator.

14. A device comprising a plurality of coupled microwave resonators, each resonator having a resonant frequency, comprising;

a first resonator substrate having an upper and a lower surface and having a plurality of microwave resonators located on the upper surface of the resonator substrate, each microwave resonator comprising a section of interdigital slow-wave coplanar transmission line and having a length approximately equal to an integral number of one-quarter wavelengths at the resonant frequency of the resonator, a second resonator substrate having an upper surface and a lower surface and having a plurality of microwave resonators located on the upper surface of the second resonator substrate, each microwave resonator comprising a section of interdigital slow-wave coplanar transmission line and having a length approximately equal to an integral number of one-quarter wavelengths at the resonant frequency of the resonator, the lower surface of the first resonator substrate being mounted adjacent to the upper surface of the second resonator substrate whereby a plurality of resonators on the first resonator substrate are coupled to a plurality of resonators on the second resonator substrate.

15. The device of claim 14 and further including first and second transmission lines, each transmission line being connected by a tap to a resonator on the first resonator substrate.

16. The device of claim 14 wherein the plurality of resonators on the first resonator substrate comprise at least a first and second resonator and further including:

a coupler substrate having top and bottom surfaces, a first coplanar transmission line located on the top surface of the coupler substrate and having a short circuit at one end of the first coplanar transmission line and having an input port at the other end of the first coplanar transmission line, a second coplanar transmission line located on the top surface of the coupler substrate and having a short circuit at one end of the second coplanar transmission line and having an output port at the other end of the second coplanar transmission line, the bottom surface of the coupler substrate being mounted adjacent to the upper surface of the first resonator substrate and the first microwave resonator being in close proximity to the short circuited end of the first coplanar transmission line, whereby the first coplanar transmission line is coupled to the first microwave resonator and the second microwave resonator being in close proximity to the short circuited end of the second coplanar transmission line, whereby the second coplanar transmission line is coupled to the second microwave resonator.

* * * * *